US008375502B2

(12) United States Patent
Scott et al.

(10) Patent No.: US 8,375,502 B2
(45) Date of Patent: Feb. 19, 2013

(54) MULTI-MATERIAL MOP HEAD

(76) Inventors: Christina Scott, Kansas City, MO (US); Kevin Neighley, Kansas City, MO (US)

( * ) Notice: Subject to any disclaimer, the term of this patent is extended or adjusted under 35 U.S.C. 154(b) by 92 days.

(21) Appl. No.: 13/115,790

(22) Filed: May 25, 2011

(65) Prior Publication Data

US 2011/0289714 A1 Dec. 1, 2011

Related U.S. Application Data

(60) Provisional application No. 61/396,266, filed on May 25, 2010.

(51) Int. Cl.
*A47L 13/12* (2006.01)
*A47L 13/20* (2006.01)

(52) U.S. Cl. ..... 15/229.1; 15/118; 15/228; 15/229.2

(58) Field of Classification Search ..... 15/228, 15/229.1, 229.2, 118
See application file for complete search history.

(56) References Cited

U.S. PATENT DOCUMENTS 7,601,655 B2 * 10/2009 Katsin ..... 442/192

* cited by examiner

*Primary Examiner* — Randall Chin
(74) *Attorney, Agent, or Firm* — Hovey Williams LLP

(57) ABSTRACT

A mop head for cleaning and drying floors and other surfaces includes a first portion formed primarily of microfiber material or similar materials and a second portion formed primarily of chamois material or similar materials. The first portion is configured for cleaning a surface as it is moved across it and the second portion is configured for drying the surface as it is moved it.

13 Claims, 5 Drawing Sheets

MULTI-MATERIAL MOP HEAD

RELATED APPLICATION

This nonprovisional patent application claims priority benefit, with regard to all common subject matter, of earlier-filed U.S. provisional patent application titled "CLEANING TOWEL," Ser. No. 61/396,266, filed May 25, 2010. The identified earlier-filed application is hereby incorporated by reference in its entirety into the present application.

This application is also related to application titled "MULTI-MATERIAL CLEANING TOWEL WITH POCKETS FOR CLEANING PRODUCTS," Ser. No. 13/115,766, filed May 25, 2011, now U.S. Pat. No. 8,292,533; and application titled "MULTI-MATERIAL CLEANING TOWEL WITH HAND POCKETS," Ser. No. 13/115,781, filed May 25, 2011, now pending, both of which are incorporated by reference in their entirety into the present application.

BACKGROUND

The present invention relates to mop heads and similar cleaning devices. More particularly, the invention relates to a mop head designed for simultaneously cleaning and drying floors and other surfaces in a single motion without the use of soap or other cleaning agents.

Many different types of mop heads have been developed for cleaning floors and other surfaces. Most existing mop heads are designed to be dipped in soap and water then wrung out before use. Unfortunately, the mop heads often leave too much mater on the surface being cleaned even after they are wrung out. Thus, the surface must either be dried with a towel or a separate dry mop or left unused while it air dries.

Additionally, conventional mop heads do not clean surfaces effectively when used with water only. Thus, conventional mop heads are typically used with soap or other cleaning agents, and this is undesirable for people who prefer to eliminate or at least minimize the use of cleaning agents for health or environmental reasons.

SUMMARY

The present invention provides a distinct advance in the art of mop heads and other similar cleaning devices by providing a mop head that simultaneously cleans and dries a floor or other surface and that works well without soap or other cleaning agents.

One embodiment of the mop head comprises a first portion and a second portion, each specifically designed for a particular function. Specifically, the first portion is formed primarily of microfiber material or similar materials and is configured for cleaning a floor or other surface as it is moved across it, and the second portion is formed primarily of chamois material or similar materials and is configured for drying the floor or other surface.

In one embodiment, the second portion forms an underlying layer of the mop head and is formed from a generally rectangular-shaped piece of chamois material or similar material. Both ends of the second portion are cut with a number of generally parallel, longitudinally extending slits that define a plurality of independently-moveable drying strips on each end of the second portion separated by an uncut central portion.

The first portion forms outer layers of the mop head and is formed from a generally rectangular-shaped piece of microfiber material or similar material that is wrapped around the central portion of the second portion. In one embodiment, the first portion is wrapped around the second portion several times to form several outer layers of material around the second portion.

The mop head may be attached to a conventional mop handle by folding the mop head over itself near its mid-point so that the drying strips on both ends of the second portion are adjacent one another and then sliding the folded end of the mop head over an attachment bar on the mop handle.

To clean a floor or other surface with the mop head, the surface may first be sprayed with water or the mop head may be dipped in clean water and then wrung out to remove excess water. Alternatively, the mop head may be used without any water for dusting purposes. The mop head is then pushed or dragged across the floor or other surface in a conventional manner.

The first portion of the mop head, which includes outer layers of microfiber material or similar materials, effectively removes dirt, water, and debris from the floor or other surface without scratching it. Also, because the first portion is thicker than the second portion, a user can firmly compress it against the floor or other surface to remove all dirt and contaminants therefrom. The second, relatively thinner portion of the mop head, which is formed primarily of water-absorbing chamois material, and which includes the drying strips, removes spots and streaks as it is dragged across the floor or other surface. Thus, a single mop head constructed in accordance with embodiments of the present invention may be used to simultaneously clean and dry a floor or other surface without soap or other cleaning agents and without leaving spots or streaks. After the mop head is used to thoroughly clean and dry the floor or other surface, it may be washed and used again and again to clean other surfaces.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
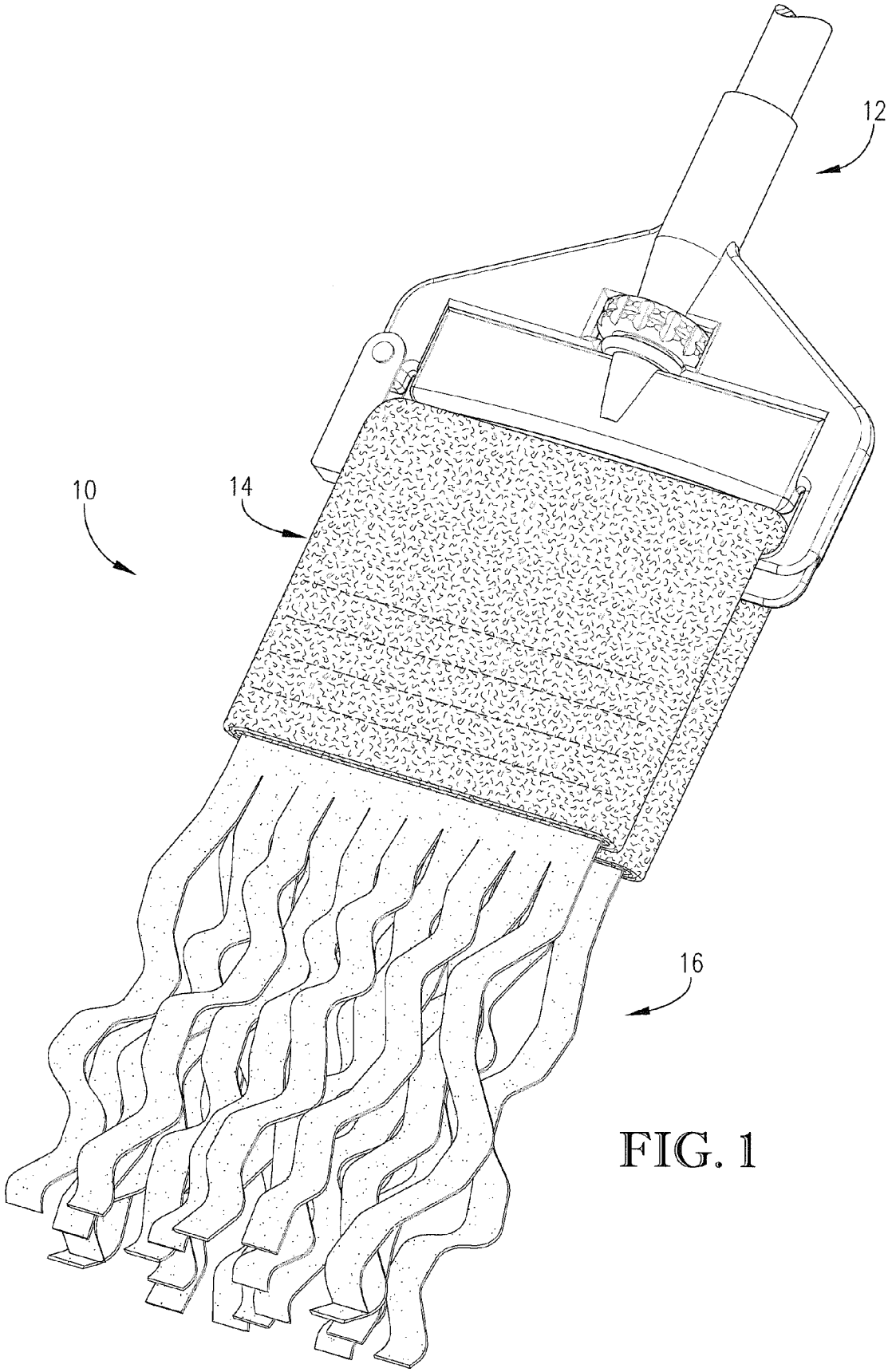
FIG. 1 is a perspective view of a mop head constructed in accordance with an embodiment of the present invention and shown attached to a mop handle.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

The invention provides various embodiments of mop heads designed for simultaneously cleaning and drying floors and other surfaces without the use of soap or other cleaning agents. The mop heads are primarily formed from microfiber material, chamois material, or other similar materials and may be any size and shape. Although the mop heads are particularly useful for cleaning floors, they can also be used to clean other surfaces.

Turning now to the drawing figures, and particularly FIG. 1, a mop head 10 constructed in accordance with embodiments of the invention is illustrated. The mop head 10 may be attached to any conventional mop handle 12 and broadly comprises a first portion 14 and a second portion 16, each designed for a particular function. Specifically, first portion 14 is configured for cleaning the floor or other surface as it is moved across the surface, and the second portion is configured for drying the floor or other surface.

Figure 4:
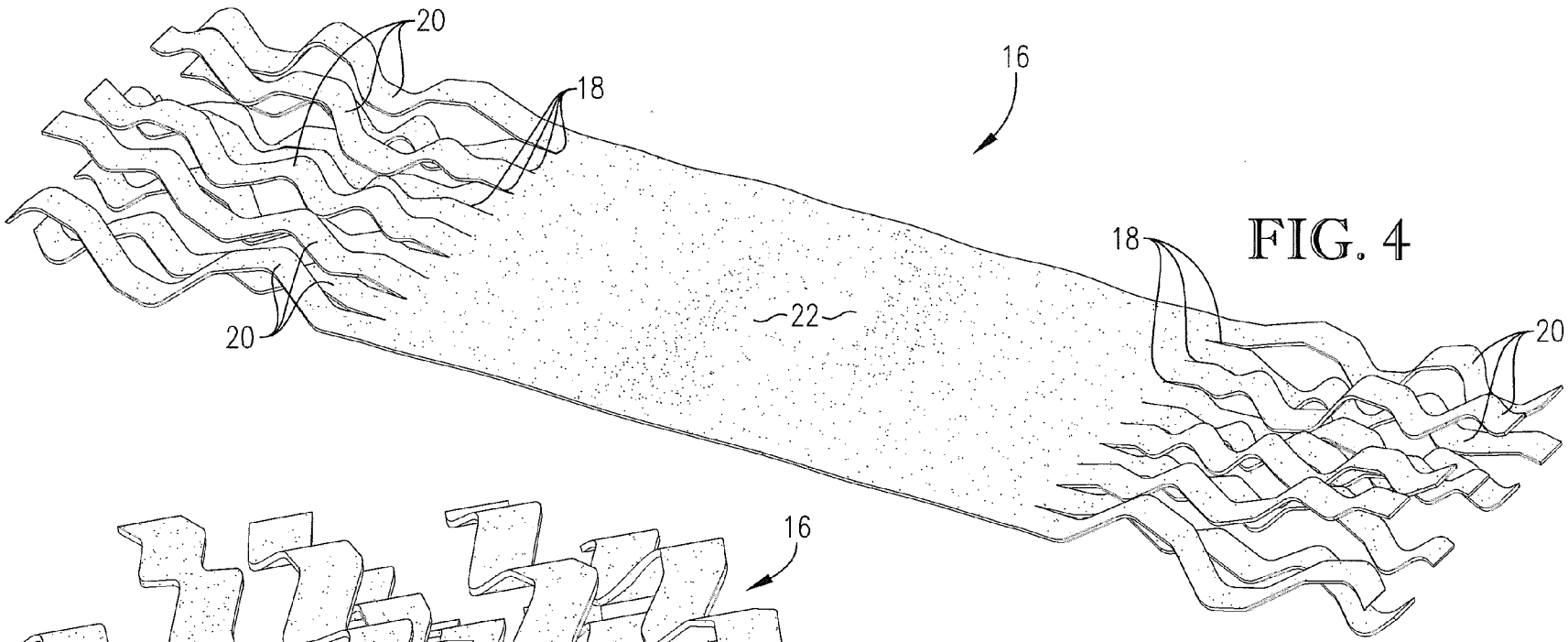
FIG. 4 is perspective view of the second portion of the mop head removed from the first portion.

Turning now to FIG. 4, one embodiment of the second portion 16 is formed from a generally rectangular-shaped piece of chamois material or similar material. The chamois material may be any size and shape, and in one embodiment is between 30-38" long, 6-10" wide; and 1/16"-1/8" thick.

Both ends of the second portion 16 are cut to form a number of generally parallel, longitudinally extending slits 18 that define a plurality of independently-moveable drying strips 20 separated by an uncut central portion 22. In one embodiment, each end of the second portion includes 8-14 drying strips, each 1/4"-3/4" wide and 8-10" long. However, the second portion may include any number of drying strips of any size without departing from the scope of the invention.

Figure 3:
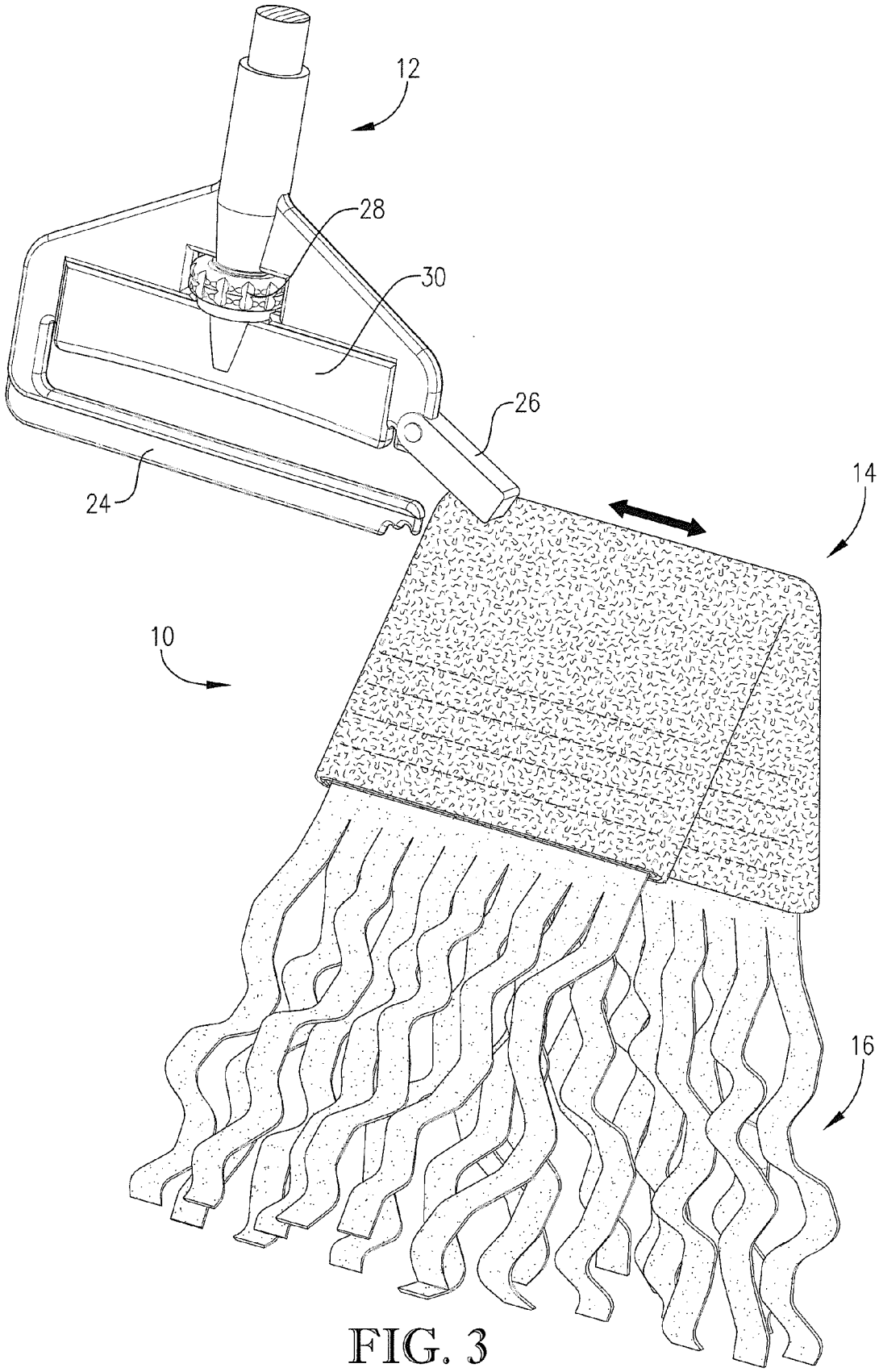
FIG. 3 is another perspective view of the mop head and mop handle showing another step in the attachment or removal of the mop head.
Figure 5:
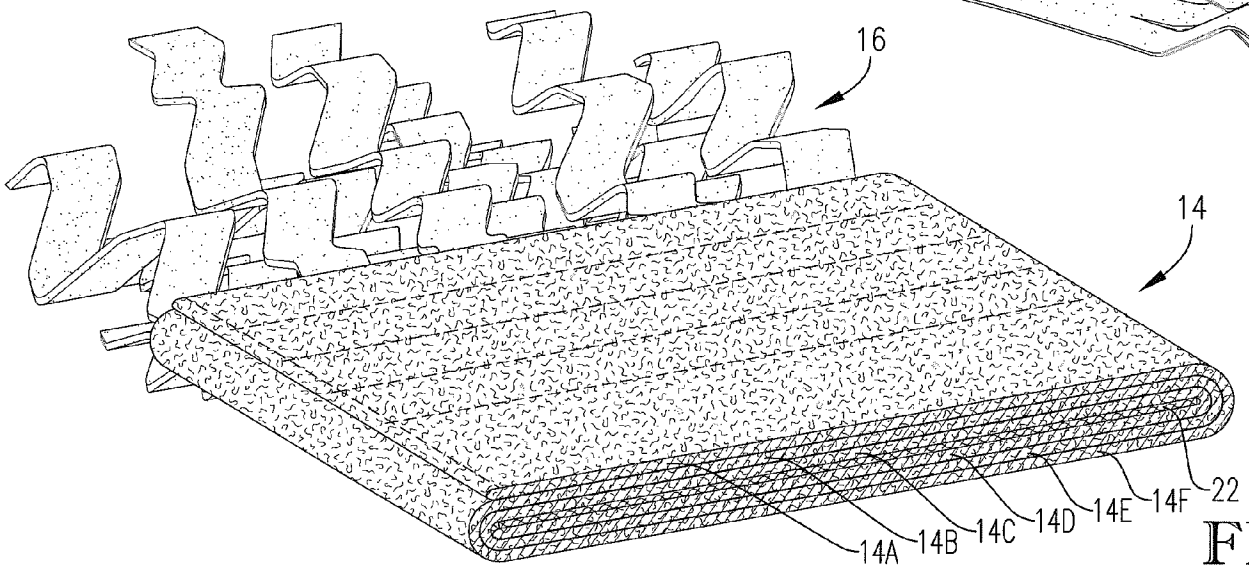
FIG. 5 is a sectional perspective view of the mop head.
Figure 6:
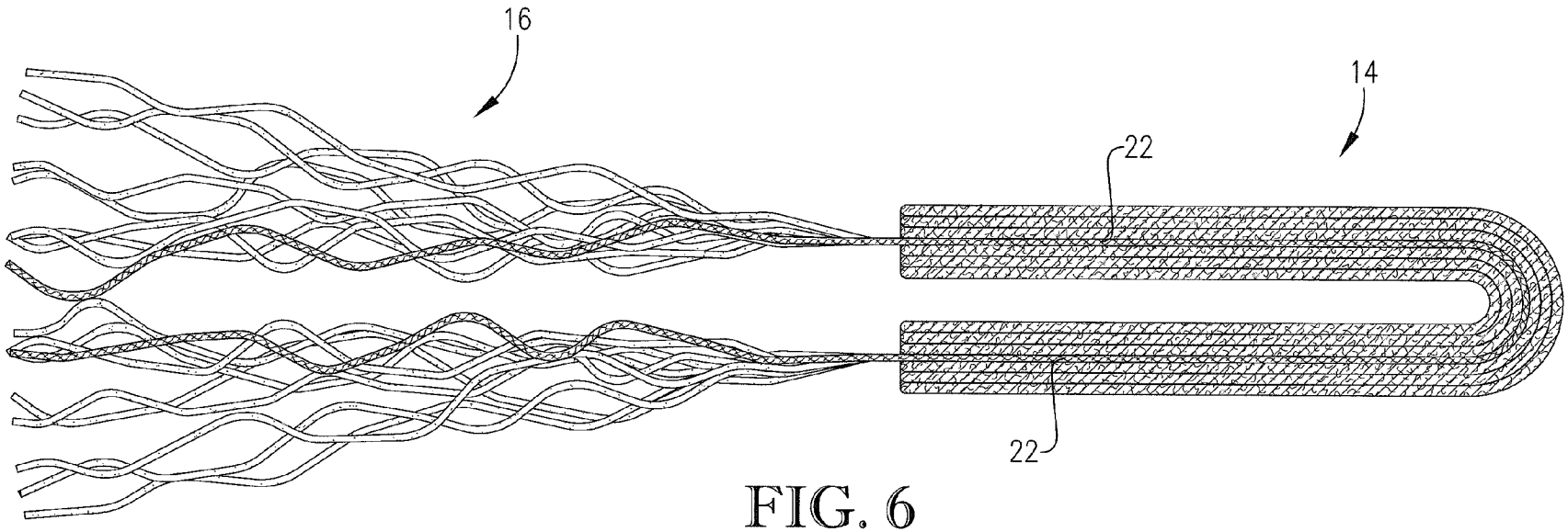
FIG. 6 is a sectional side view of the mop head after it has been folded but before it has been attached to a mop handle.

Turning now to FIGS. 3, 5, and 6, one embodiment of the first portion 14 is formed from a generally rectangular-shaped piece of microfiber material or similar material that is wrapped around the central portion 22 of the second portion 16 and stitched or otherwise fastened to the second portion. Although stitch lines are shown between the first and second portions 14, 16 in the drawing figures, the stitches may be on the inside of the layers and therefore not visible or may be replaced with adhesives or other fasteners.

In one embodiment, the microfiber material that foams the first portion is approximately 12-15" wide and 40-60" long and is wrapped around the central portion three times. Thus, as best illustrated in FIGS. 5 and 6, the central portion 22 of the second portion 16 forms an underlying layer of the mop head and the microfiber material that foams the first portion 14 forms three outer layers 14A-F on each side of the central portion 22. The microfiber material may be approximately 1/16"-1/8" thick, such that the entire second portion of the mop head, which consists of six total layers 14A-F of the microfiber material and an underlying layer 22 of chamois, is between 7/16"-7/8" thick.

In another embodiment, the second portion 16 includes two separated ends, each with drying strips 20, but no connecting central portion 22. This reduces the amount of chamois material or similar material in the mop head and therefore reduces its cost. This also makes the first portion 14 of the mop more flexible and easier to attach to a mop handle because there is no underlying layer of chamois material near the center of the first portion.

Figure 2:
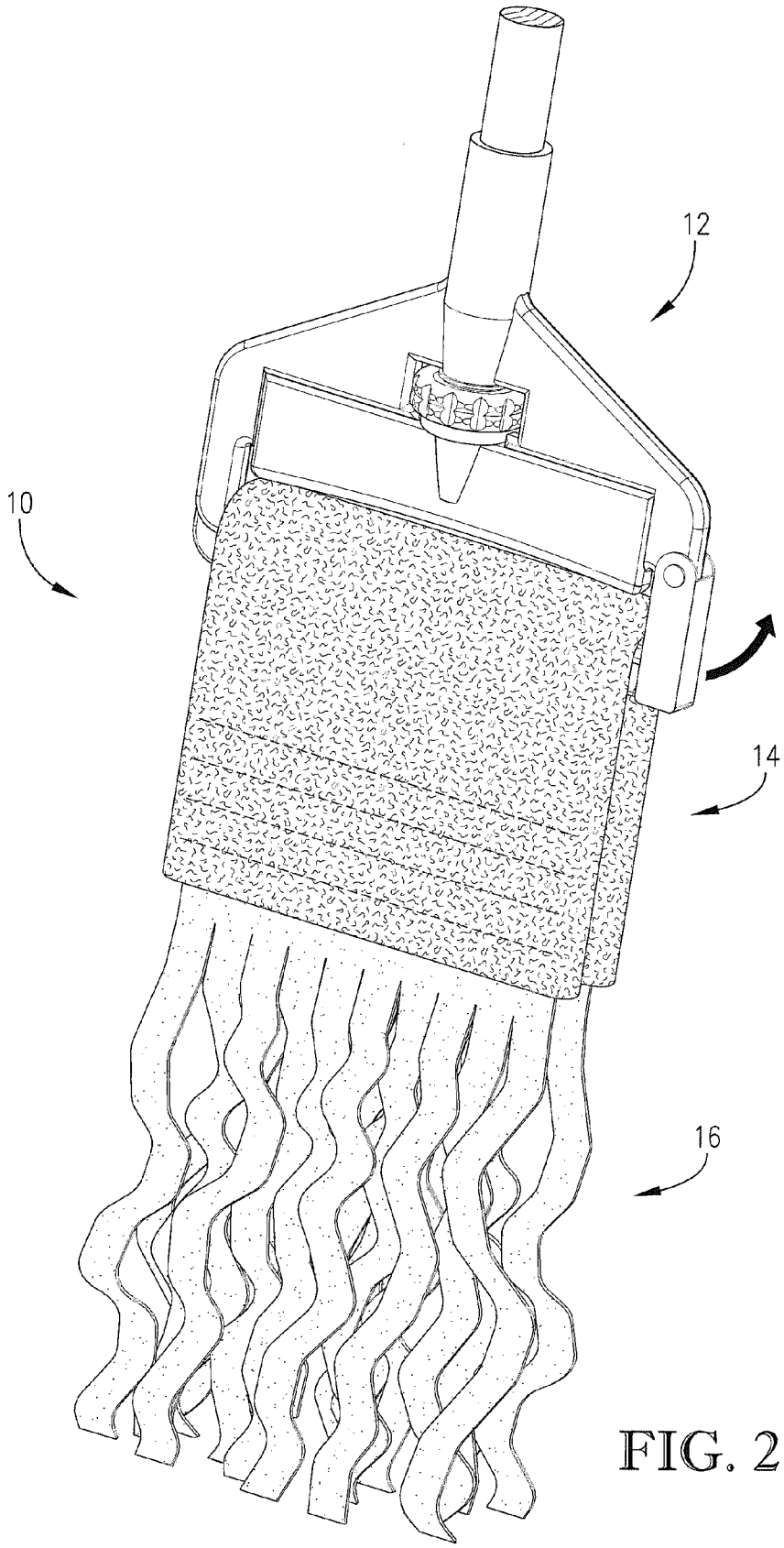
FIG. 2 is another perspective view of the mop head and mop handle showing a step in the attachment or removal of the mop head.

Referring now to FIGS. 1-3, the mop head 10 may be attached to the mop handle 12 by folding the mop head over itself so that the drying strips on both ends of the second portion 16 are adjacent one another. The folded end of the mop head is then slid over an attachment bar 24 on the mop handle and a latch 26 is closed. An adjustment wheel 28 may then be operated to urge a retainer 30 against the mop head to hold it in place.

To clean a floor or other surface with the mop head 10, the surface may first be sprayed with water or the mop head may be dipped in clean water and then wrung out to remove excess water. Alternatively, the mop head may be used without any water for dusting purposes. The mop head is then pushed or dragged across the floor or other surface in a conventional manner.

The first portion 14 of the mop head, which includes outer layers of microfiber material or similar materials, effectively removes dirt, water, and debris from the floor or other surface without scratching it. Also, because the first portion is thicker than the second portion, a user can firmly compress it against the floor or other surface to remove all dirt and contaminants therefrom. The second, relatively thinner portion 16 of the mop head, which is formed primarily of water-absorbing chamois material, and which includes the drying strips 20, removes spots and streaks as it is pushed or dragged across the floor or other surface. Thus, a single mop head constructed in accordance with embodiments of the present invention may be used to simultaneously clean and dry a floor or other surface without soap or other cleaning agents and without leaving spots or streaks. After the mop head is used to thoroughly clean and dry the floor or other surface, it may be washed and used again and again to clean other surfaces.

In other embodiments, a pocket or pockets may be formed in the first portion of the mop head for holding soaps, disinfectant towels, and/or other cleaning agents. One such pocket is disclosed in U.S. Patent Application Ser. No. 61/123,690, titled "Cleaning Towel", filed on Apr. 7, 2000, which is hereby incorporated into the present application in its entirety by reference. Other embodiments of such pockets are described in the first application identified in the Related Applications section on page 1 of this application. For example, referring to FIG. 1, stitch lines may be provided anywhere on the first portion to form one or more pockets. A slit or other opening may then be formed in the pockets to receive soaps, disinfectant towels, etc.

Although the invention has been described with reference to the preferred embodiment illustrated in the attached drawing figures, it is noted that equivalents may be employed and substitutions made herein without departing from the scope of the invention as recited in the claims. For example, the mop head described herein can be made in any size and shape without departing from the scope of the invention. Also, although the mop head 10 is particularly useful for cleaning and drying floors, it can also used to clean other objects and surfaces.

Having thus described the preferred embodiment of the invention, what is claimed as new and desired to be protected by Letters Patent includes the following:

1. A mop head for cleaning and drying floors and other surfaces, the mop head comprising:

a first portion formed primarily of microfiber material and configured for cleaning the surface as it is moved across the surface; and a second portion formed primarily of chamois material and configured for drying the surface as it is moved across the surface, wherein the second portion includes a plurality of drying strips on each of its ends separated by an intermediate portion, with the intermediate portion forming an underlying layer of the mop head.

2. The mop head as set forth in claim 1, wherein the first portion is formed from a generally rectangular-shaped piece of microfiber material that is wrapped around the intermediate portion of the second portion to form outer layers of the mop head.

3. The mop head as set forth in claim 1, wherein the mop head is attached to a mop handle by folding the mop head over itself and placing the folded end over an attachment bar of the mop handle.

4. The mop head as set forth in claim 1, wherein the first portion is approximately 7/16" to 7/8" thick.

5. The mop head as set forth in claim 1, wherein the second portion is approximately 1/16" to 1/8" thick.

6. The mop head as set forth in claim 1, wherein each of the drying strips is approximately 8-10" long, 1/4-3/4"wide; and 1/16-1/8"thick.

7. A mop head for cleaning and drying floors and other surfaces, the mop head comprising:

a first portion formed primarily of microfiber material and configured for cleaning the surface as it is moved across the surface; and a second portion formed primarily of chamois material and configured for drying the surface as it is moved across the surface, wherein the second portion is formed from a generally rectangular-shaped piece of chamois material which has been cut to form a plurality of drying strips on each of its ends separated by an uncut intermediate portion, with the intermediate portion forming an underlying layer of the mop head.

8. The mop head as set forth in claim 7, wherein the first portion is formed from a generally rectangular-shaped piece of microfiber material that is wrapped around the intermediate portion of the second portion to form outer layers of the mop head.

9. The mop head as set forth in claim 7, wherein the mop head is attached to a mop handle by folding the mop head over itself and placing the folded end over an attachment bar of the mop handle.

10. The mop head as set forth in claim 7, wherein the first portion is approximately 7/16" to 7/8" thick.

11. The mop head as set forth in claim 7, wherein the second portion is approximately 1/16" to 1/8" thick.

12. A mop for cleaning and drying floors and other surfaces, the mop comprising:

a mop head comprising— a first portion formed primarily of microfiber material and configured for cleaning the surface as it is moved across the surface; and a second portion formed primarily of chamois material and configured for drying the surface as it is moved across the surface, wherein the second portion is formed from a generally rectangular-shaped piece of chamois material which has been cut to form a plurality of drying strips on each of its ends separated by an uncut intermediate portion, with the intermediate portion forming an underlying layer of the mop head; and a mop handle, wherein the mop head is attached to the mop handle by folding the mop head over itself and placing the folded end over an attachment bar of the mop handle.

13. The mop as set forth in claim 12, wherein the first portion of the mop head is formed from a generally rectangular-shaped piece of microfiber material that is wrapped around the intermediate portion of the second portion to form outer layers of the mop head.

* * * * *